US007462069B2

(12) United States Patent
Studerus

(10) Patent No.: US 7,462,069 B2
(45) Date of Patent: Dec. 9, 2008

(54) CABLE PLUG FOR A COAXIAL CABLE AND METHOD FOR MOUNTING A CABLE PLUG OF THIS TYPE

(75) Inventor: Peter Studerus, Niederuzwil (CH)

(73) Assignee: Huber+Suhner AG, Herisau (CH)

( * ) Notice: Subject to any disclaimer, the term of this patent is extended or adjusted under 35 U.S.C. 154(b) by 0 days.

(21) Appl. No.: 11/667,286

(22) PCT Filed: Nov. 8, 2005

(86) PCT No.: PCT/CH2005/000662

§ 371 (c)(1),
(2), (4) Date: May 8, 2007

(87) PCT Pub. No.: WO2006/047907

PCT Pub. Date: May 11, 2006

(65) Prior Publication Data

US 2008/0045081 A1 Feb. 21, 2008

(30) Foreign Application Priority Data

Nov. 8, 2004 (CH) ..... 1833/04

(51) Int. Cl.
*H01R 9/05* (2006.01)

(52) U.S. Cl. ..... 439/584; 439/583

(58) Field of Classification Search ..... 439/578, 439/583–585

See application file for complete search history.

(56) References Cited

U.S. PATENT DOCUMENTS 4,046,451 A 9/1977 Juds et al.
4,687,272 A * 8/1987 Spinner et al. ..... 439/271
5,267,877 A 12/1993 Scannelli et al.
5,518,420 A 5/1996 Pitschi
5,595,502 A * 1/1997 Allison ..... 439/429
5,766,037 A * 6/1998 Nelson ..... 439/583
5,951,327 A 9/1999 Marik
6,032,358 A 3/2000 Wild
6,036,237 A 3/2000 Sweeney
6,080,015 A * 6/2000 Andreescu ..... 438/584
6,267,621 B1 * 7/2001 Pitschi et al. ..... 439/584
6,386,915 B1 * 5/2002 Nelson ..... 439/584
2005/0023832 A1 2/2005 Edler

FOREIGN PATENT DOCUMENTS

EP 0045038 A1 2/1982
EP 0599602 A1 6/1994
EP 0901200 A2 3/1999
EP 0938165 A1 8/1999
WO 2004055943 A1 7/2004

* cited by examiner

*Primary Examiner*—Tho D Ta
(74) *Attorney, Agent, or Firm*—The Webb Law Firm

(57) ABSTRACT

A cable plug for a coaxial cable, in particular comprising an external corrugated conductor, comprises an electrically conductive housing, which concentrically surrounds an insulated internal conductor, in addition to fixing elements which are used to connect the external conductor of the coaxial cable electrically and mechanically to the housing of the cable plug. The cable plug permits a particularly simple configuration and assembly. To achieve this, the fixing elements ensure a fixed and sealed connection between the external conductor of the coaxial cable and the housing of the cable plug.

21 Claims, 6 Drawing Sheets

CABLE PLUG FOR A COAXIAL CABLE AND METHOD FOR MOUNTING A CABLE PLUG OF THIS TYPE

BACKGROUND OF THE INVENTION

1) Field of the Invention

The present invention relates to the field of plug-in connector technology for coaxial cables and to a method for fitting such a cable plug.

2) Description of Related Art

Coaxial cables, as are used nowadays, for example, in the sector of base stations of mobile radio networks, have, in a concentric arrangement, an inner conductor and an outer conductor, which are insulated from one another by a dielectric lying therebetween. The outer conductor is generally surrounded by a protective outer sheath consisting of plastic. The outer conductor of a coaxial cable can be in the form of metallic braiding (at frequencies which are not too high). However, it can also be in the form of a continuous tube. If an increased flexibility of the cable is not required, the tube of the outer conductor may have smooth walls. In order to achieve increased flexibility, corrugated tubes or hoses consisting of metal are generally used as the outer conductor, it being possible for the corrugations to either be separated annularly or continuously helical.

In many cases it is desirable to provide detachable connections for such coaxial cables in order to simplify fitting and maintenance. For this purpose, a large number of cable plugs have been developed and proposed in the past which differ from one another in terms of cable type and fixing concept. In principle, such a cable plug needs to fulfill the following requirements:

- The cable plug needs to produce good electrical contact between the plug housing, which generally forms the outer conductor within the plug, and the outer conductor of the cable.
- The cable plug needs to ensure a mechanical connection having a high tensile strength between the plug housing and the outer conductor of the cable in order to ensure that the plug-in connection can be subjected to a sufficient mechanical load.
- The cable plug, in particular if the plug-in connection—as in the case of base stations—is subjected to weathering influences, needs to adjoin the outer sheath of the coaxial cable in a sealing manner in order to prevent the ingress of moisture, dirt and other influences on the interior of the cable.
- Other, constant requirements relate to a simple design, fitting which is as simple as possible and cost-effective manufacture and storage.

A known cable plug which is suitable in particular for coaxial cables having an outer conductor with annular corrugations is illustrated in longitudinal section in FIG. 1. The cable plug 10 has a housing 18, which acts as the outer conductor and in which an inner conductor 16 is held concentrically and in electrically insulated fashion by means of an insulator 15. A union nut 11 is fitted such that it can be rotated on the plug-in side end on the housing 18 by means of a snap ring 13, with which union nut the cable plug 10, once it has been inserted into a corresponding female connector, can be screwed to the female connector. For guidance purposes during the insertion, an annular insert 14 is provided around which a seal 12 is arranged. On the cable side of the cable plug 10, the inner conductor 16 merges with a seal 21, which rests in an inner conductor 19 and produces the electrical contact with the inner conductor of the coaxial cable (not illustrated). The cable-side screw connection, which is used for contact-making, retaining and sealing purposes, comprises a large number of different parts: in order to make contact with and retain the outer conductor of the coaxial cable, a contact sleeve 24 is provided which is split into individual, radially sprung tongues by axially running slits 23 arranged distributed over the circumference. The contact sleeve 24 has, on the plug-in side, an edge which thickens in the form of a bead inwards and with which the contact sleeve 24 bears against a circumferential projection 22 shaped in the interior of the housing 18. A flanged edge of the outer conductor of the cable is clamped in between the bead-shaped edge of the contact sleeve 24 and the projection 22 during fitting in order to produce the electrical contact between the housing 18 and the outer conductor and to mechanically fix the cable. The fixing of the outer conductor is illustrated in detail, for example, in the figures of EP-A2-0 901 200.

The contact ring 24 is pressed in clamping fashion against the projection 22 by means of a first hollow screw 20, which can be screwed into the housing 18. At the same time, in order to provide sealing between the first hollow screw 20 and the housing 18, an inner seal 17 is compressed. In order to provide sealing between the first hollow screw 20 and the outer conductor of the cable, a further seal 25 is provided which surrounds the outer conductor and is pressed radially inwards against the outer conductor by being compressed axially by means of a further hollow screw 26. Finally, a further seal 17' is provided in the second hollow screw 26, which further seal 17' provides sealing with respect to the outer sheath of the cable.

Owing to the various screw connections and seals, the design and fitting of the known cable plug shown in FIG. 1 are complicated and laborious. One of the reasons for these disadvantages can be found in the contact sleeve 24: the contact sleeve 24 could in principle, if it were to be in the form of a sleeve without slits, press the flanged edge of the cable outer conductor against the projection 22 uniformly over the entire circumference and therefore not only produce the necessary electrical and mechanical contact but at the same time also take on the sealing function for the outer conductor with respect to the housing. Further seals may therefore not be required and it would be possible to implement a significantly simplified cable plug which can be fitted more easily. However, the contact sleeve 24 has slits, since it is necessary for the contact sleeve 24, in the case of a cable having an outer conductor with annular corrugations, to be capable of being pushed onto the outer conductor, on the one hand, despite the corrugation and, on the other hand, to dip into the first corrugation trough with the beaded edge behind the flanged conductor edge in order to press the conductor edge safely against the projection 22. Such configurations are not only known from EP-A2-0 901 200, but also from U.S. Pat. No. 4,046,451 or EP-A1-0 938 165.

A slightly different situation results if the coaxial cable has a corrugated outer conductor with a helical corrugation, as is the case in documents EP-A1-0 599 602 or U.S. Pat. No. 5,518,420 or U.S. Pat. No. 6,032,358. Here, in principle a closed sleeve, i.e. one without slits, can be used as the contact sleeve and has a thread structure, which matches the helical corrugation of the outer conductor, on the inner side and can be screwed onto the outer conductor like a nut. Even in this case, sealing is not obviously considered at the flanged edge of the outer conductor since, in all cases, additional sealing means such as O rings or the like are provided in order to seal the cable plug off towards the outside.

SUMMARY OF THE INVENTION

The object of the invention is therefore to provide a cable plug for a coaxial cable, in particular having an outer conductor with annular corrugations, which avoids the disadvantages of known cable plugs and is characterized in particular by a simplified, cost-effective design and simplified fitting, as well as to specify a method for fitting said cable plug.

The essence of the invention consists in designing the fixing means for fixing the cable outer conductor to the cable plug such that, with the fixing, at the same time a sealing connection is produced between the outer conductor of the coaxial cable and the housing of the cable plug. As a result, it is possible to dispense with further sealing means and additional screw connections, and a particularly simple cable plug which can be fitted easily and is also suitable in principle for all types of cable outer conductors results.

One preferred configuration of the invention is characterized by the fact that the fixing means comprise a sealing and clamping ring, which is pushed over the end of the outer conductor of the coaxial cable and, with an annular, first sealing face, presses an edge at the end of the outer conductor in a sealing manner against a continuous and annular, second sealing face, which is arranged in the housing of the cable plug, and that the sealing and clamping ring is arranged and guided axially within the housing.

In order to actuate the sealing and clamping ring, provision is advantageously made for the fixing means to further comprise a screw element, which can be screwed to the housing of the cable plug and, when it is screwed to the housing, exerts an axial force on the sealing and clamping ring. The screw element is in particular in the form of a nut or hollow screw, which has a pressure ring on the inside, with which it dips into the housing when screwed and presses onto the sealing and clamping ring in the axial direction.

In order that the sealing and clamping ring can be used without any problems in all types of corrugated and uncorrugated outer conductors, it is advantageous that the sealing and clamping ring is designed to be closed annularly, that the sealing and clamping ring has a conically tapering ring section towards the sealing side, that a corresponding conical guide face is arranged in the housing, on which guide face the sealing and clamping ring is guided with its conical ring section towards the axis, that the first sealing face is designed to be continuous, and that the two sealing faces are oriented essentially at right angles to the conical guide face.

The deformation of the sealing and clamping ring during screwing is facilitated if the sealing and clamping ring is cylindrical on the side facing away from the sealing side and has a ring section with a reduced wall thickness in the cylindrical part, adjacent to the conical ring section.

The sealing and clamping ring may consist of a metallic material, in particular of stainless steel. However, it may also consist of a plastic or a composite material.

The production of the cable plug is simplified if the second sealing face and possibly the conical guide face are formed on a metallic adjusting ring, which is inserted into the housing of the cable plug and is in electrical contact with the housing.

A configuration of the cable plug in accordance with the invention which is an alternative to the closed sealing and clamping ring is characterized by the fact that the sealing and clamping ring is designed as an open ring provided with a split or designed to comprise a plurality of ring segments. It can therefore be pushed over the corrugations of the outer conductor without any difficulties in the slightly open state and, after closing, can be fixed axially in a simple manner in a corrugation trough. Owing to the opening split, much less severe forces are required for the clamping and sealing in order to press the end of the outer conductor with a radial component against the corresponding sealing face.

Preferably, the fixing means further comprise a screw element, which can be screwed to the housing of the cable plug and, when screwed to the housing, exerts an axial force on the sealing and clamping ring, means for guidance being provided on the sealing and clamping ring and on the screw element and preventing the sealing and clamping ring from tipping.

In particular, the guide means comprise a v-shaped guide groove in the front face of the screw element and a v-shaped edge contour, which matches said guide groove, on the sealing and clamping ring.

The sealing and clamping ring may be essentially cylindrical. In this case, it preferably has a circumferential annular bead on the inside, with which annular bead it presses the outer conductor against the second sealing face. The use of the sealing and clamping ring is further simplified if it is designed to be mirror-symmetrical with respect to a central plane passing through the annular bead.

However, the sealing and clamping ring may also be conical.

In the method according to the invention, the flanged edge can be clamped in in particular by means of a screw connection.

BRIEF DESCRIPTION OF THE DRAWINGS

The invention will be explained in more detail below with reference to exemplary embodiments in connection with the drawing, in which.

DETAILED DESCRIPTION OF THE INVENTION

Figure 1:
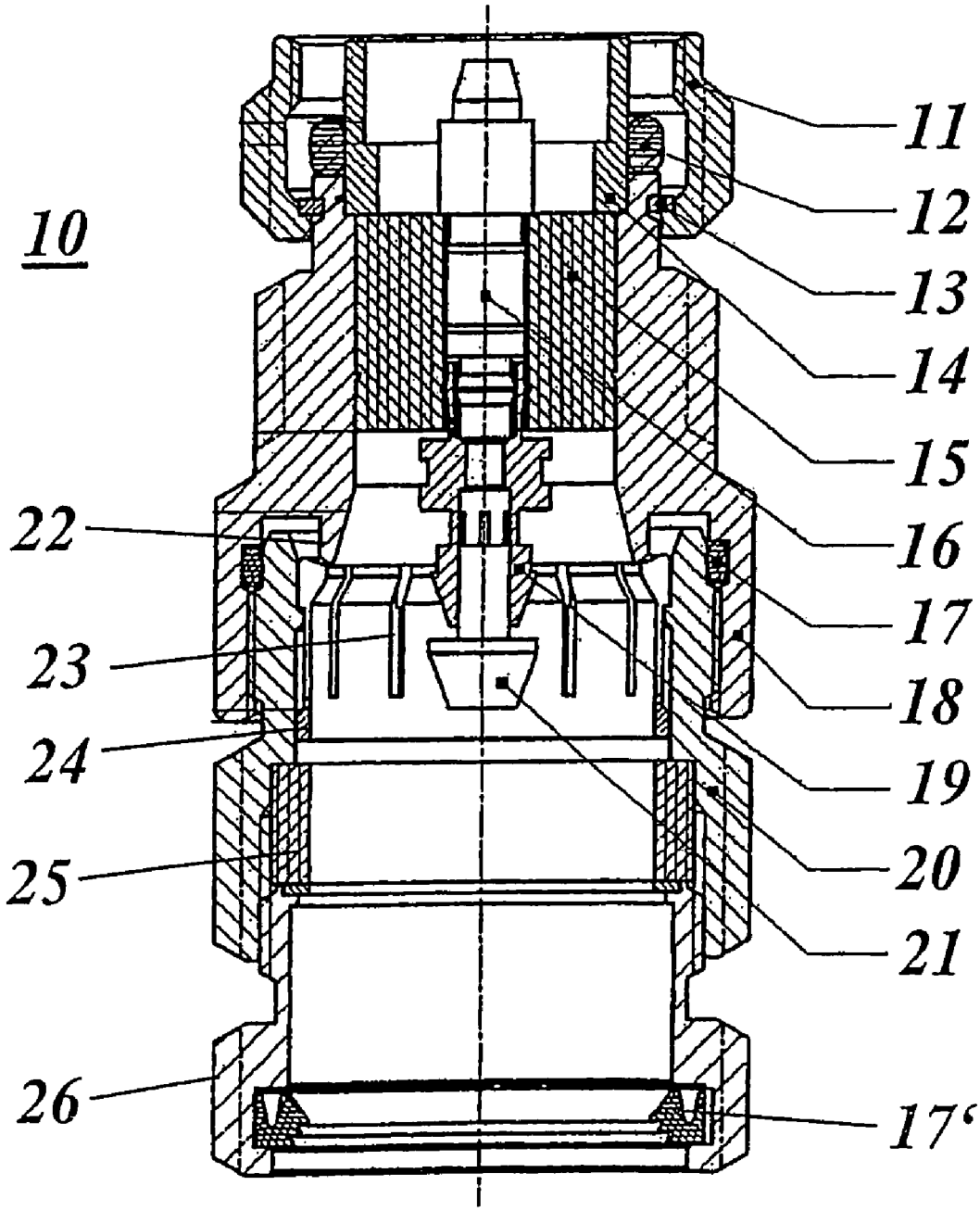
PRIOR ART Fig.1
FIG. 1 shows a longitudinal section through a cable plug for cables with a corrugated outer conductor in accordance with the prior art.
Figure 2:
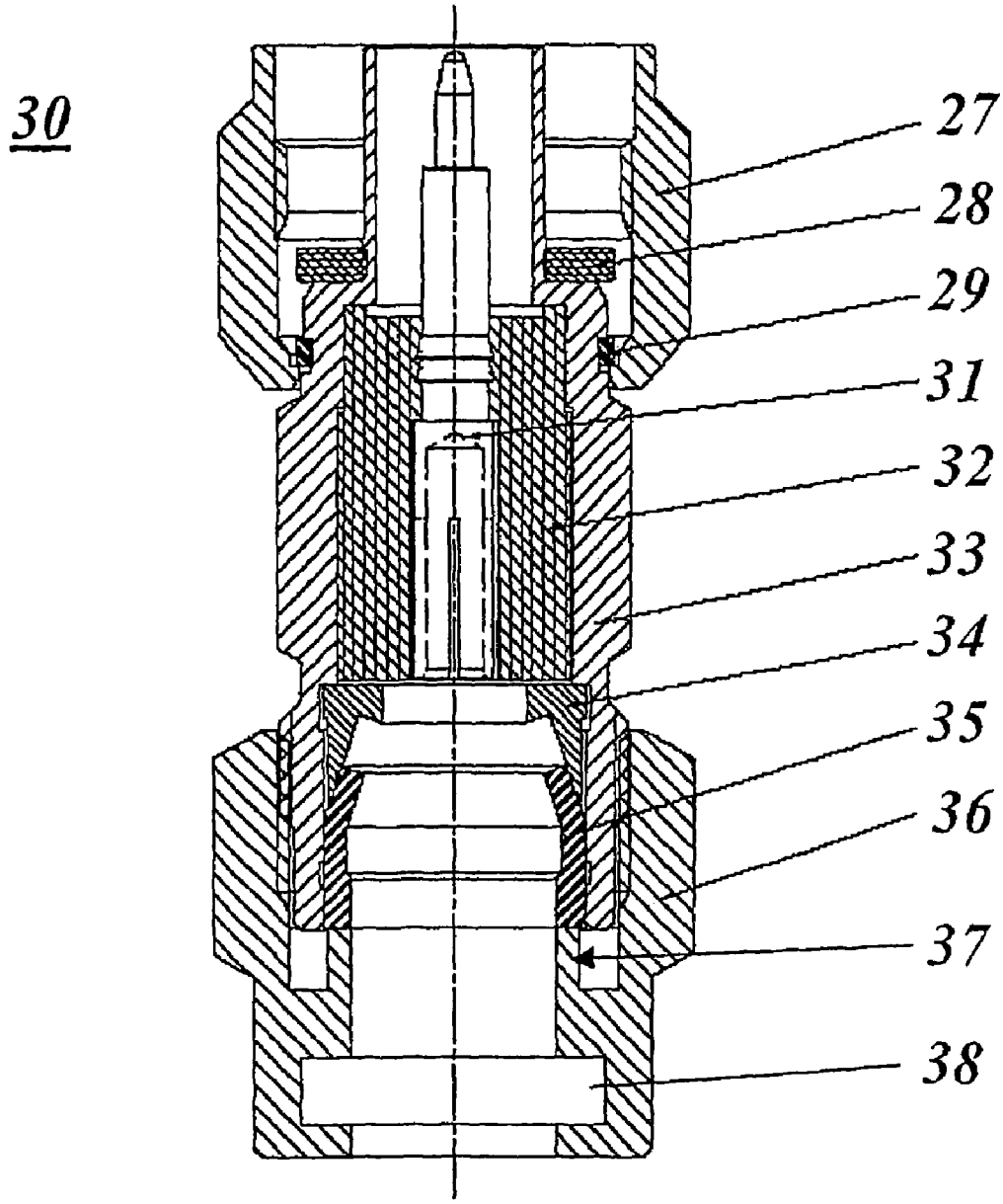
FIG. 2 shows a longitudinal section through a cable plug in accordance with a preferred exemplary embodiment of the invention.

With reference to FIG. 2, a preferred exemplary embodiment of a cable plug according to the invention is reproduced. The cable plug 30 comprises a housing 33, which concentrically surrounds an inner conductor 31, which is held in insulated fashion e housing by means of an insulator 32. In turn, a union nut 27 is fixed with the aid of a snap ring 29 such that it can be rotated at the plug-in side end of the housing 33. For sealing purposes in interaction with the female connector, a seal 28 is provided. In order to fix, make contact with and seal the outer conductor of the coaxial cable, a screw connection is provided which comprises three elements, namely an adjusting ring 34 consisting of metal, for example brass, which is inserted into the housing 33 and is supported on a shoulder at the level of the insulator 32, a sealing and clamping ring 35 and a nut 36. The nut 36 can be screwed onto the housing 33 at the cable-side end, the cable being guided through a central through-hole in the nut 36. A pressure ring 37 is formed in the interior of the nut 36, dips into the central hole in the housing 33 when the nut 36 is screwed onto the housing 33 and presses on the cable-side ring face of the sealing and clamping ring 35.

Figure 3:
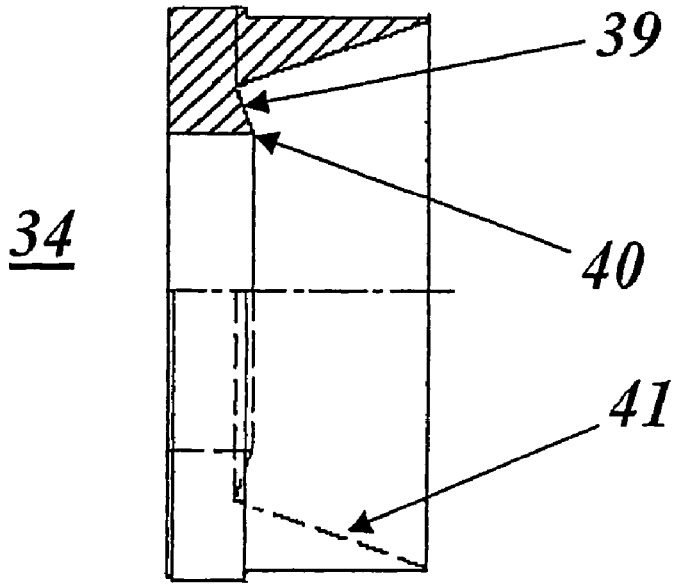
FIG. 3 shows, partially sectioned, the adjusting ring of the cable plug from FIG. 2.
Figure 4:
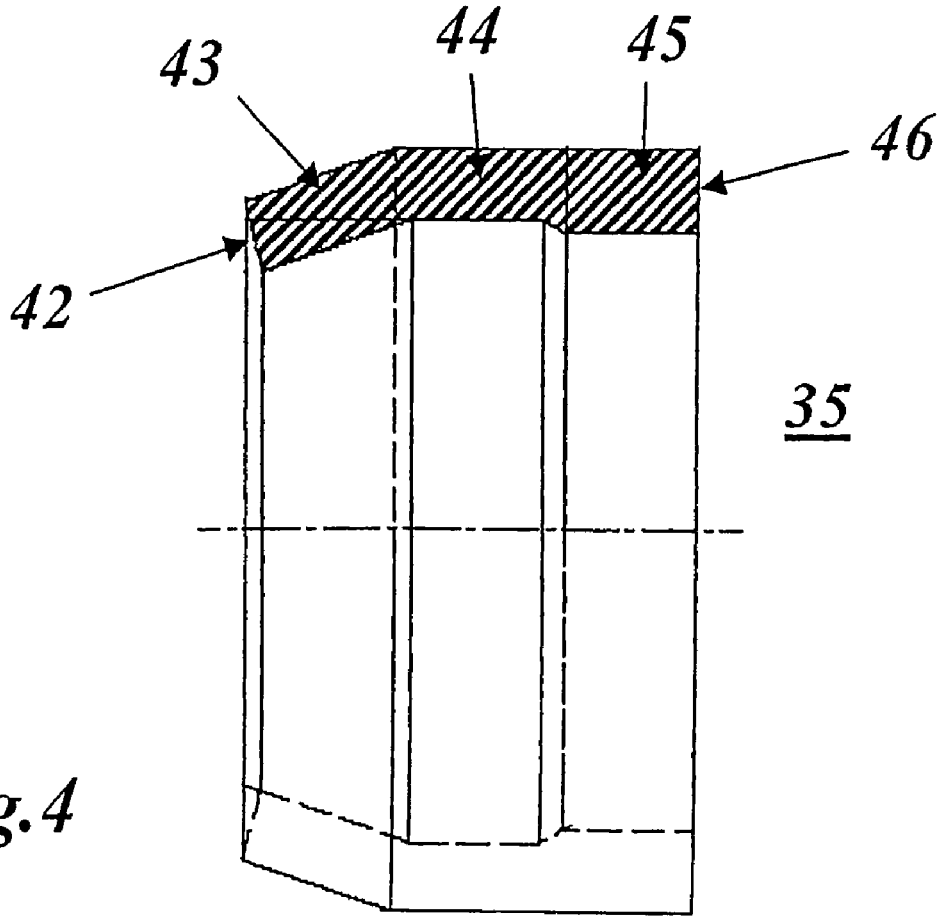
FIG. 4 shows, partially sectioned, the sealing and clamping ring of the cable plug from FIG. 2.
Figure 5:
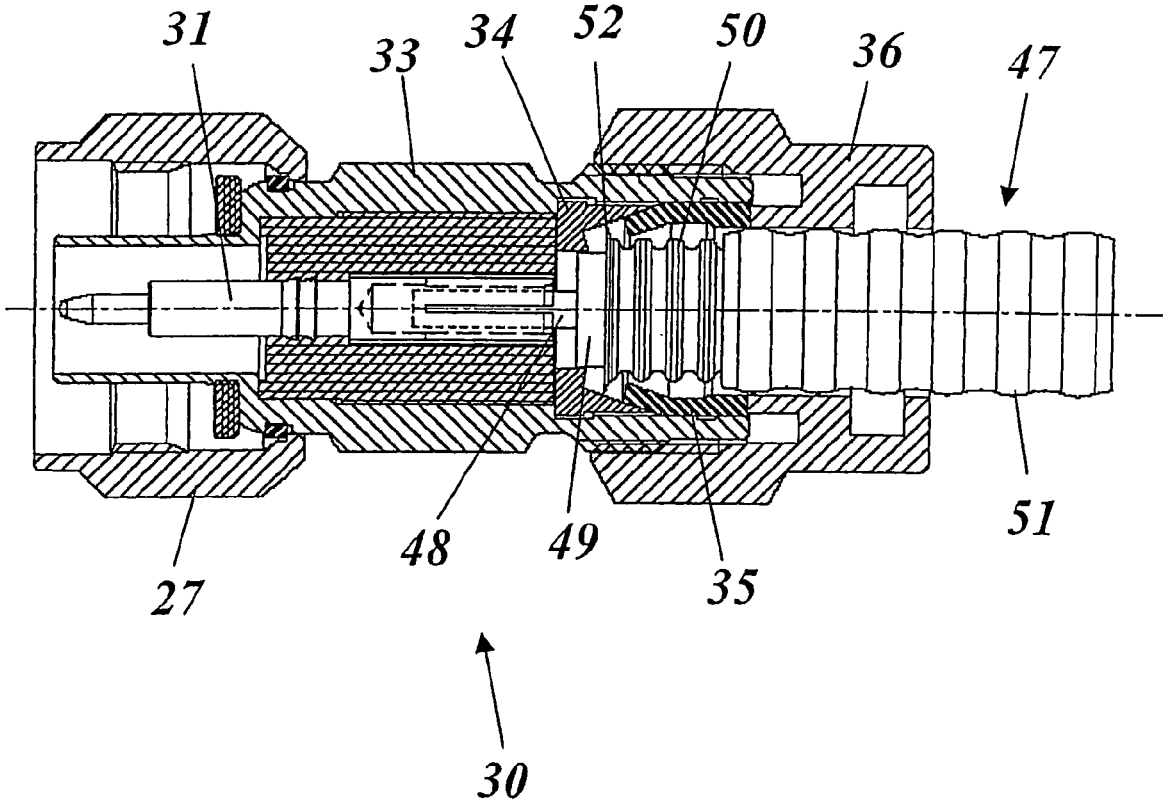
FIG. 5 shows the cable plug from FIG. 2 with a cable having an outer conductor with annular corrugations, shortly before the screwing process.

The adjusting ring 34 and the sealing and clamping ring 35, which are illustrated individually in FIGS. 3 and 4, form, with their mutually assigned sealing faces 39 and 42, a clamping mechanism, which clamps the flanged edge 52 on the outer conductor 50 of an introduced coaxial cable 47 in when the cable plug 30 is screwed (see FIG. 5). In order that the sealing and clamping ring 35 can be pushed over the corrugations of an outer conductor 50 with annular corrugations without any problems (as is shown in FIG. 5), but at the same time can also engage safely behind the flanged edge 52 when screwed together, it comprises a plurality of ring sections 43, 44 and 45, of which the plug-in side ring section 43 tapers conically in the plug-in direction and the two other ring sections 44 and 45 are cylindrical. A corresponding conical guide face 41 on the adjusting ring 34 lies opposite the conical ring section 43 and causes the conical ring section 43 to be increasingly narrowed when the cable plug 30 is screwed and therefore when the sealing and clamping ring 35 is inserted into the housing 33. This narrowing results in the sealing and clamping ring pressing an edge of the outer conductor 50 of sufficient width against the sealing face 39 on the adjusting ring 34 and therefore ensuring reliable sealing.

In order to make safe clamping possible in the case of a conically widened flanged edge 52 and the inwardly directed narrowing movement of the sealing and clamping ring 35, the two sealing faces 39 and 42 on the adjusting ring 34 and the sealing and clamping ring 35, respectively, are oriented essentially at right angles to the conical guide face 41. Since the two sealing faces 39, 42 form closed, uniform rings, the flanged edge 52, which is clamped in between the two sealing faces 39, 42, acts as a metallic sealing ring.

The sealing and clamping ring 35, as a closed ring (without any slits), is subjected to considerable mechanical loads during screwing owing to the narrowing associated therewith. It therefore needs to be produced from a suitable material in order to withstand these loads. In particular, the material of the sealing and clamping ring 35 should also be selected such that as few intermodulations as possible occur within the cable plug 30 on signal transmission. A metallic material such as, for example, aluminum or in particular stainless steel (V2A, material No. 4301) has proven successful. However, it should be nonmagnetic in order not to negatively influence the conduction properties in the cable plug. However, other materials such as plastics or composite materials can also be used. Such a suitable composite material is, for example, a PTFE filled with small metal particles. The sealing and clamping ring 35 can additionally be coated in order to make it subject to as little friction as possible.

When fitting the cable plug 30 shown in FIG. 5, first the nut 36 is pushed over the coaxial cable 47. Then, the sealing and clamping ring 35 is pushed over an exposed end of the outer conductor 50 of the coaxial cable 47.

Subsequently, the edge at the end of the outer conductor 50 is flanged on the outside to form a flanged edge 52. Then, the cable is inserted with the exposed inner conductor 48 into the female connector part, which has slits, of the inner conductor 31 in the cable plug 30. Finally, the nut 36 is screwed onto the housing 33 until the flanged edge is clamped in uniformly around the circumference between the two sealing faces 39, 42 in a sealing and retaining manner and in a manner providing electrical contact. An exposed section of the dielectric 49 of the cable is in this case accommodated by the adjusting ring 34. Towards the rear out, the coaxial cable 47 can additionally be sealed by a sealing ring, which is introduced into a corresponding annular groove 38 in the nut 36.

The sealing clamping of the flanged edge 52 in the cable plug 30 shown in FIG. 5 is not restricted to coaxial cables having an outer conductor with annular corrugations, but can also be used in cables having an outer conductor with helical corrugations or in cables having a straight, tubular outer conductor, with the result that, on top of the advantageous simple design and simple fitting, a single plug type can be used for many types of cable. Even in the case of cables with a braided outer conductor, corresponding clamping can be achieved with the novel cable plug without, however, it being possible for sufficient simultaneous sealing to be ensured.

The previously explained exemplary embodiment shown in FIGS. 2-5 was based on a closed sealing and clamping ring, which, owing to its constant inner diameter is not only subject to restrictions when pushed onto the outer conductor of the coaxial cable but also requires considerable forces during the clamping and sealing.

An improvement in this respect can be achieved if, in the context of the invention, a sealing and clamping ring is used which is not completely closed but is open, i.e. is provided with a slit or a split at least at one point, or overall comprises a plurality of independent ring segments. Owing to the design as an open ring, the inner diameter of the sealing and clamping ring can be enlarged by being bent up temporarily so as to facilitate the procedure for pushing it onto the outer conductor, with the result that the sealing and clamping ring can then be pushed over the corrugations of the outer conductor without any effort. Once it has been pushed on, the inner diameter can be reduced in size again by being bent together. The sealing and clamping ring then assumes, for example, a position between two adjacent corrugations which is secured against being axially displaced.

Figure 6:
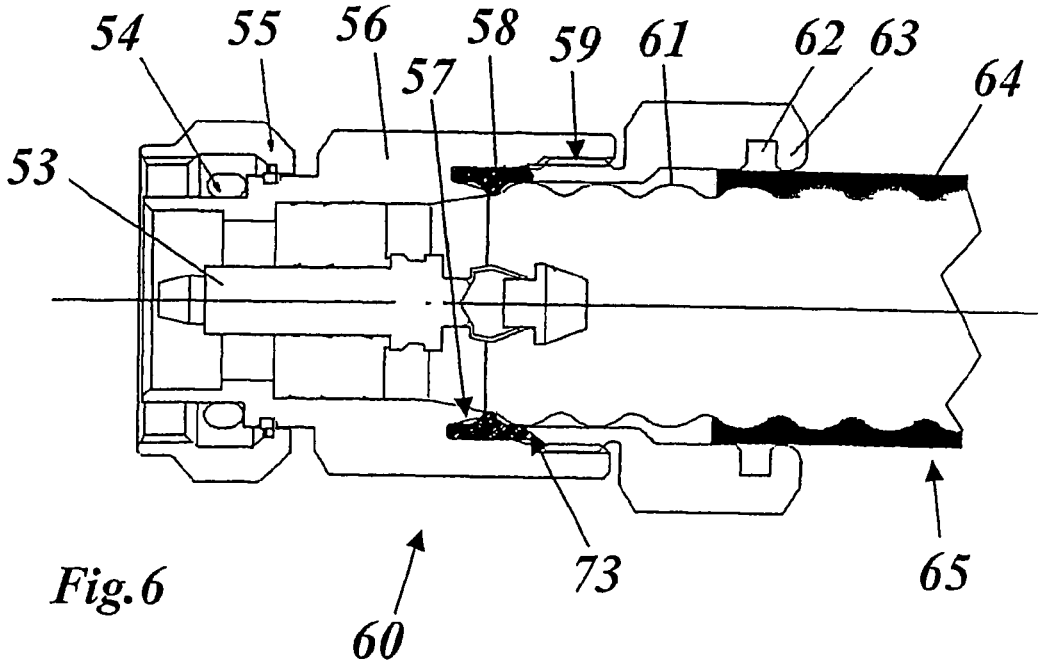
FIG. 6 shows a simplified longitudinal section through another preferred exemplary embodiment of the invention with an open (split) sealing and clamping ring of the type illustrated in FIG. 7.
Figure 7:
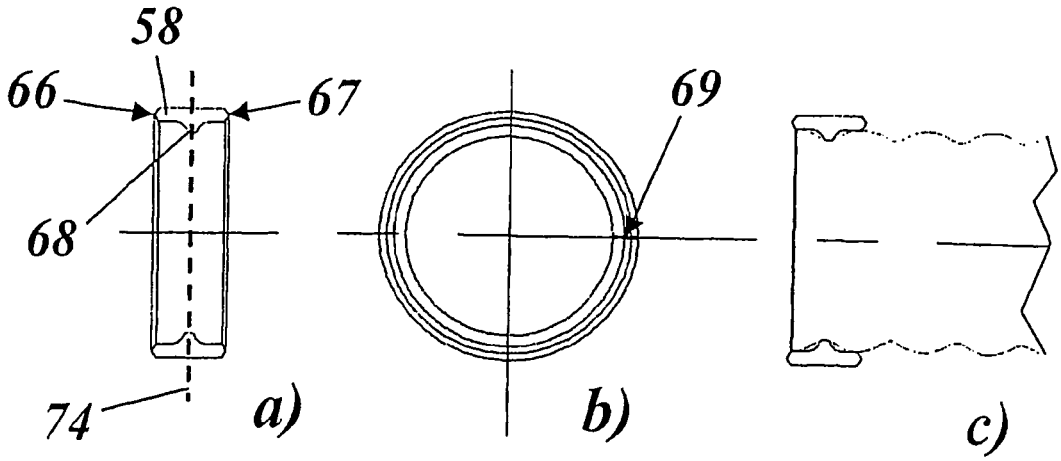
FIG. 7 shows, in various subfigures 7(*a*)-(*c*), the sealing and clamping ring from FIG. 6, in section (FIG. 7*a*), in a front view (FIG. 7*b*) and in the fitted state on the end of the outer conductor (FIG. 7*c*)

A first exemplary embodiment for a cable plug with an open sealing and clamping ring is reproduced in FIGS. 6 and 7, in which case no hatching of the sectioned parts has been provided. The cable plug 60 in FIG. 6 has a similar design to the cable plug 30 from FIG. 5. A housing 56 coaxially surrounds an inner conductor 53, which is retained in insulated fashion in the housing 56. A union nut 55 is provided for the plug-in connection, and an annular seal 54 is used for sealing the plug-in connection. From the opposite side, the end of a coaxial cable 65 having a corrugated outer conductor 61 and a surrounding outer sheath 64 is inserted into the cable plug 60. The connection of the inner conductor of the coaxial cable 65 to the inner conductor 53 of the cable plug 60 is not illustrated in FIG. 6.

For the sealing clamping of the outer conductor 61 in the housing 56, an open sealing and clamping ring 58 (with slits or splits) is provided which is illustrated individually in FIG. 7. The metallic sealing and clamping ring 58 is essentially cylindrical. It is mirror-symmetrical with respect to a central plane 74 at right angles to the ring axis. In the central plane 74, an inwardly protruding, circumferential annular bead 68 is integrally formed on the inner side of the sealing and clamping ring 58, which annular bead, when the screw connection 59, 63 is tightened, presses the outer conductor 61 in sealing and clamping fashion against a sealing face 57, which is formed slightly conically on the housing 56. Since the sealing and clamping ring 58 is provided with a radial split 69 (FIG. 7*b*), it can be compressed comparatively easily when the cable plug 60 is screwed whilst reducing the size of the inner diameter and therefore produces the required contact pressure for the outer conductor 61.

The screw connection comprises a hollow screw 63 (with an inner sealing groove 62) and a corresponding thread arrangement 59. The hollow screw 63 has a v-shaped guide groove 73 on the front end facing the sealing and clamping ring 58, which guide groove accommodates a corresponding v-shaped edge contour 66, 67 on the sealing and clamping ring and thus guides the sealing and clamping ring 58 during the screwing and prevents it from tipping. The sealing and clamping ring 58 enters axially into a corresponding bore in the housing 56, which is delimited towards the inside by the conical sealing face 57. The annular bead 68, which fixes the sealing and clamping ring 58 at the same time in a corrugation trough of the outer conductor 61 (see also FIG. 7*c*), presses the outer conductor 61 in sealing and clamping fashion inwards against the sealing face 57.

Figure 8:
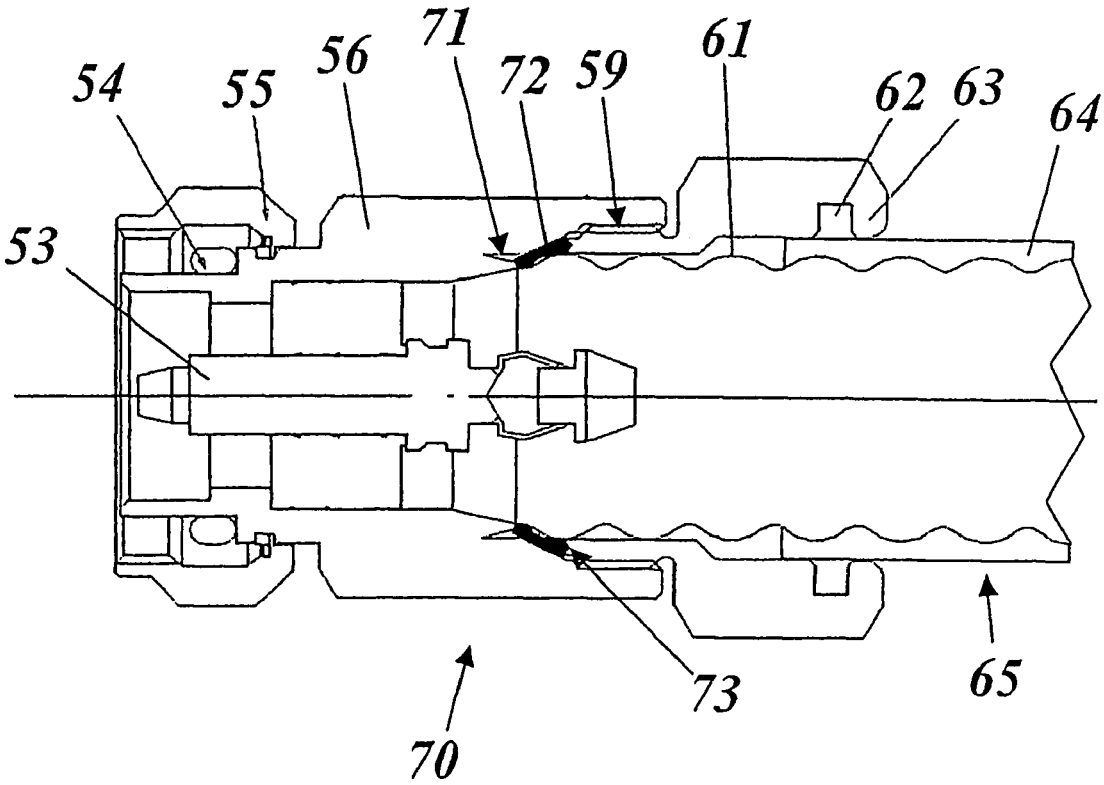
FIG. 8 shows a simplified longitudinal section through a further preferred exemplary embodiment of the invention with an open (split) sealing and clamping ring, which is conical.

A slightly different configuration of the open sealing and clamping ring is implemented in the cable plug 70 from FIG. 8. The sealing and clamping ring 72 in this case has a conical shape, with which the ring, with its front end, presses the outer conductor 61 in sealing and clamping fashion against a corresponding sealing face 71.

The open sealing and clamping ring has the following features and advantages:

The sealing and clamping ring has splits and makes sealing possible owing to the guidance in the housing of the cable plug.

With the open sealing and clamping ring, the sealing is brought about virtually without any complexity in terms of deformation. The force used is conducted directly and without losses to the sealing faces from the outer conductor.

Owing to the reduced expenditure of force, a reduction in the physical length of the cable plug of up to 25% is possible.

The sealing and clamping ring can be reused up to 30 times, since it does not become plastically deformed.

The sealing and clamping ring is so far open that it can be pushed over the corrugations of the outer conductor without any problems.

Even during the insertion into the housing, the ring is so far closed that it can no longer slide out of the corrugation of the outer conductor.

The v-shaped guide on the nut prevents the ring from tipping.

The invention claimed is:

1. A cable plug for a coaxial cable having an outer conductor with annular corrugations comprising:

an electrically conductive housing concentrically surrounding an inner conductor arranged in an insulated fashion in the housing; and fixing means for electrically and mechanically connecting the housing of the cable plug to the outer conductor of the coaxial cable, wherein the fixing means establishes a sealing connection between the outer conductor of the coaxial cable and the housing of the cable plug, wherein the fixing means comprise a sealing and clamping ring, the sealing and clamping ring is pushed over the end of the outer conductor of the coaxial cable and, with an annular, first sealing face, presses an edge at the end of the outer conductor in a sealing manner against a continuous and annular, second sealing face arranged in the housing of the cable plug, and wherein the fixing means further comprise a screw element screwed to the housing of the cable plug and, when it is screwed to the housing, exerts an axial force on the sealing and clamping ring.

2. The cable plug as claimed in claim 1, wherein the screw element is in the form of at least one of a nut and a hollow screw.

3. The cable plug as claimed in claim 1, wherein the screw element is a nut having a pressure ring on an inside portion thereof that dips into the housing when screwed and presses onto the sealing and clamping ring in the axial direction.

4. The cable plug as claimed in claim 1, wherein the sealing and clamping ring is coated thereby producing limited friction.

5. The cable plug as claimed in claim 1, wherein the sealing and clamping ring is adapted to be closed annularly, such that the sealing and clamping ring has a conically tapering ring section towards a sealing side, thereby providing a corresponding conical guide face arranged in the housing, on which guide face the sealing and clamping ring is guided with a conical ring section towards an axis thereof, the first sealing face is continuous, and the first sealing face and the second sealing face are oriented essentially at right angles to the conical guide face.

6. The cable plug as claimed in claim 5, wherein the second sealing face and the conical guide face are formed on a metallic adjusting ring, which is inserted into the housing of the cable plug and is in electrical contact with the housing.

7. The cable plug as claimed in claim 5, wherein the sealing and clamping ring is cylindrical on a side facing away from the sealing side.

8. The cable plug as claimed in claim 7, wherein the sealing and clamping ring has a ring section with a reduced wall thickness in a cylindrical part adjacent to the conical ring section.

9. The cable plug as claimed in claim 1, wherein the sealing and clamping ring is constructed from a metallic material, a plastic material, a composite material or any combination thereof.

10. The cable plug as claimed in claim 9, wherein the sealing and clamping ring is construction from stainless steel.

11. The cable plug as claimed in claim 1, wherein the sealing and clamping ring is adapted to be an open ring provided with a split or configured to comprise a plurality of ring segments.

12. The cable plug as claimed in claim 11, wherein the sealing and clamping ring is conical.

13. The cable plug as claimed in claim 11, wherein the fixing means further comprise a screw element adapted to be screwed to the housing of the cable plug and, when screwed to the housing, exerts an axial force on the sealing and clamping ring, and means for guidance are provided on the sealing and clamping ring and on the screw element to prevent the sealing and clamping ring from tipping.

14. The cable plug as claimed in claim 13, wherein the guide means comprise a v-shaped guide groove in a front face of the screw element and a v-shaped edge contour on the sealing and clamping ring, matching the guide groove.

15. The cable plug as claimed in claim 11, wherein the sealing and clamping ring is essentially cylindrical.

16. The cable plug as claimed in claim 15, wherein the sealing and clamping ring has a circumferential annular bead on an inside portion thereof, with which annular bead it presses the outer conductor against the second sealing face.

17. The cable plug as claimed in claim 16, wherein the sealing and clamping ring is adapted to be mirror-symmetrical with respect to a central plane passing through the annular bead.

18. A method for fitting the cable plug as claimed in claim 5 to the coaxial cable, the method comprising the steps of:

pushing the sealing and clamping over an exposed end of the outer conductor of the coaxial cable thereby flanging an edge at an end of the outer conductor on an outside of the outer conductor to form a flanged end; and clamping the flanged edge uniformly around a circumference between the first sealing face and the second sealing face in a sealing and retaining manner and in a manner providing electrical contact.

19. The method as claimed in claim 18, wherein the flanged edge is clamped in by means of a screw connection.

20. A method for fitting the cable plug as claimed in claim 11 to the coaxial cable, the method comprising the steps of:

pushing the sealing and clamping ring in an open state thereby creating an opening over an end of the outer conductor of the coaxial cable thereby closing the opening and fixing the opening in a corrugation trough of the outer conductor in an axial direction;

pressing an edge at the end of the outer conductor against the second sealing face; and clamping the edge at the end of the outer conductor uniformly around a circumference between the first sealing face and the second sealing face in a retaining manner and in a manner providing electrical contact.

21. The method as claimed in claim 20, wherein the edge is clamped in by means of a screw connection.

* * * * *

UNITED STATES PATENT AND TRADEMARK OFFICE

CERTIFICATE OF CORRECTION

PATENT NO. : 7,462,069 B2
APPLICATION NO. : 11/667286
DATED : December 9, 2008
INVENTOR(S) : Peter Studerus It is certified that error appears in the above-identified patent and that said Letters Patent is hereby corrected as shown below:

Column 8, Line 46, Claim 10, "ring is construction" should read -- ring is constructed --

Column 9, Line 9, Claim 18, "sealing and clamping over" should read -- sealing and clamping ring over --

Signed and Sealed this

Fifth Day of May, 2009

John Doll

JOHN DOLL
*Acting Director of the United States Patent and Trademark Office*